US007896211B2

(12) United States Patent
Tu

(10) Patent No.: US 7,896,211 B2
(45) Date of Patent: Mar. 1, 2011

(54) NAILING MECHANISM FOR A PACKING PLATES

(76) Inventor: Wen-Yi Tu, Taichung County (TW)

( * ) Notice: Subject to any disclaimer, the term of this patent is extended or adjusted under 35 U.S.C. 154(b) by 229 days.

(21) Appl. No.: 12/319,786

(22) Filed: Jan. 13, 2009

(65) Prior Publication Data

US 2010/0176178 A1 Jul. 15, 2010

(51) Int. Cl.
*B27F 7/02* (2006.01)
*B25B 27/14* (2006.01)

(52) U.S. Cl. ..... 227/50; 227/45; 198/604; 198/605; 29/281.3; 29/772; 29/784; 29/786

(58) Field of Classification Search ..... 227/45, 227/50, 99, 103; 29/771, 772, 281.3, 784, 29/786; 198/575, 576, 604–606, 626.1, 626.5, 198/861.1

See application file for complete search history.

(56) References Cited

U.S. PATENT DOCUMENTS 3,755,871 A * 9/1973 Nelson, Jr. ..... 29/430
3,913,203 A * 10/1975 Gardini et al. ..... 29/714
3,968,560 A * 7/1976 Vial ..... 29/430
4,015,722 A * 4/1977 Cooper et al. ..... 414/788.2
4,168,566 A * 9/1979 Streckert ..... 29/432
4,285,621 A * 8/1981 Spencer ..... 414/790
4,359,149 A * 11/1982 Erlichman et al. ..... 198/347.1
4,373,651 A * 2/1983 Fanslow ..... 227/3
4,394,952 A * 7/1983 Crane ..... 227/7
4,403,388 A * 9/1983 Belcher ..... 29/429
4,479,600 A * 10/1984 Albright ..... 227/48
4,793,540 A * 12/1988 Mangan et al. ..... 227/7
5,058,795 A * 10/1991 Tonus ..... 227/7
5,133,446 A * 7/1992 Draghetti ..... 198/418.5
5,249,352 A * 10/1993 Landers ..... 29/432
5,362,040 A * 11/1994 Midavaine et al. ..... 271/225
5,375,315 A * 12/1994 Griffith et al. ..... 29/432
5,379,513 A * 1/1995 Thompson et al. ..... 29/772
5,555,617 A * 9/1996 Pope ..... 29/772
6,058,601 A * 5/2000 DeKoning ..... 29/798
6,176,009 B1 * 1/2001 Inman ..... 29/772
6,430,800 B1 * 8/2002 Buck ..... 29/430
6,736,591 B2 * 5/2004 Buck ..... 414/797.9
6,739,031 B2 * 5/2004 Shimizu ..... 29/430
6,814,272 B2 * 11/2004 Storti ..... 227/100
7,717,034 B2 * 5/2010 Madgar ..... 100/35
2001/0013459 A1 * 8/2001 Pattantyus-Abraham et al. ..... 198/339.1
2001/0034930 A1 * 11/2001 Phillips et al. ..... 29/33 R
2003/0205606 A1 * 11/2003 Storti ..... 227/100
2007/0107212 A1 * 5/2007 Holliger ..... 29/772
2007/0108682 A1 * 5/2007 Holliger ..... 269/37

* cited by examiner

*Primary Examiner*—Rinaldi I Rada
*Assistant Examiner*—Gloria R Weeks

(57) ABSTRACT

A nailing mechanism for a packing plate comprises a middle feeding device, an upper feeding device, a lower feeding device, a first conveying belt, a second conveying belt, a third conveying belt, a first push panel, a second push panel, a plurality of first nail guns, and a plurality of second nail guns, wherein the nailing mechanism are used to automatically assemble a plurality of first, second, and third slabs together to make a finished packing plate, thus lowering production costs and enhancing manufacturing efficiency.

4 Claims, 14 Drawing Sheets

NAILING MECHANISM FOR A PACKING PLATES

BACKGROUND OF THE INVENTION

1. Field of the Invention

The present invention relates to a nailing mechanism for a packing plate that are used to automatically assemble a plurality of first, second, and third slabs together to make a finished packing plate, thus lowering production costs and enhancing manufacturing efficiency.

2. Description of the Prior Art

A convention packing plate is manually made by nailing a plurality of first, second, and third slabs together, thus consuming time and causing high production cost.

The present invention has arisen to mitigate and/or obviate the afore-described disadvantages.

SUMMARY OF THE INVENTION

The primary objective of the present invention is to provide a nailing mechanism for a packing plate that are used to automatically assemble a plurality of first, second, and third slabs together to make a finished packing plate, thus lowering production costs and enhancing manufacturing efficiency.

The nailing mechanism for the packing plate according to the present invention comprises:

a first feeding device to receive and move a plurality of first slabs of the packing plate;

a second feeding device disposed above the first feeding device to receive and move a plurality of second slabs of the packing plate;

a third feeding device mounted below the first feeding device to receive and move a plurality of third slabs of the packing plate;

a first conveying belt fixed below the first feeding device to carry the fed first slabs of the packing plate;

a second conveying belt mounted above a rear section of the first conveying belt and on an outlet of the second feeding device to hold and convey a combination of the first and second slabs with the rear section of the first conveying belt;

a third conveying belt fixed below a rear section of the second conveying belt and on an outlet of the third feeding device to hold and convey a combination of the first and third slabs with the rear section of the second conveying belt;

a plurality of first nail guns arranged on a middle section of the second conveying belt in response to the number and the arrangement of the first slabs so as to nail the second slabs onto the first slabs securely;

a plurality of second nail guns arranged on a front section of the third conveying belt in response to the number and the arrangement of the first slabs so as to nail the third slabs onto the first slabs securely.

DETAILED DESCRIPTION OF THE PREFERRED EMBODIMENTS

Figure 1:
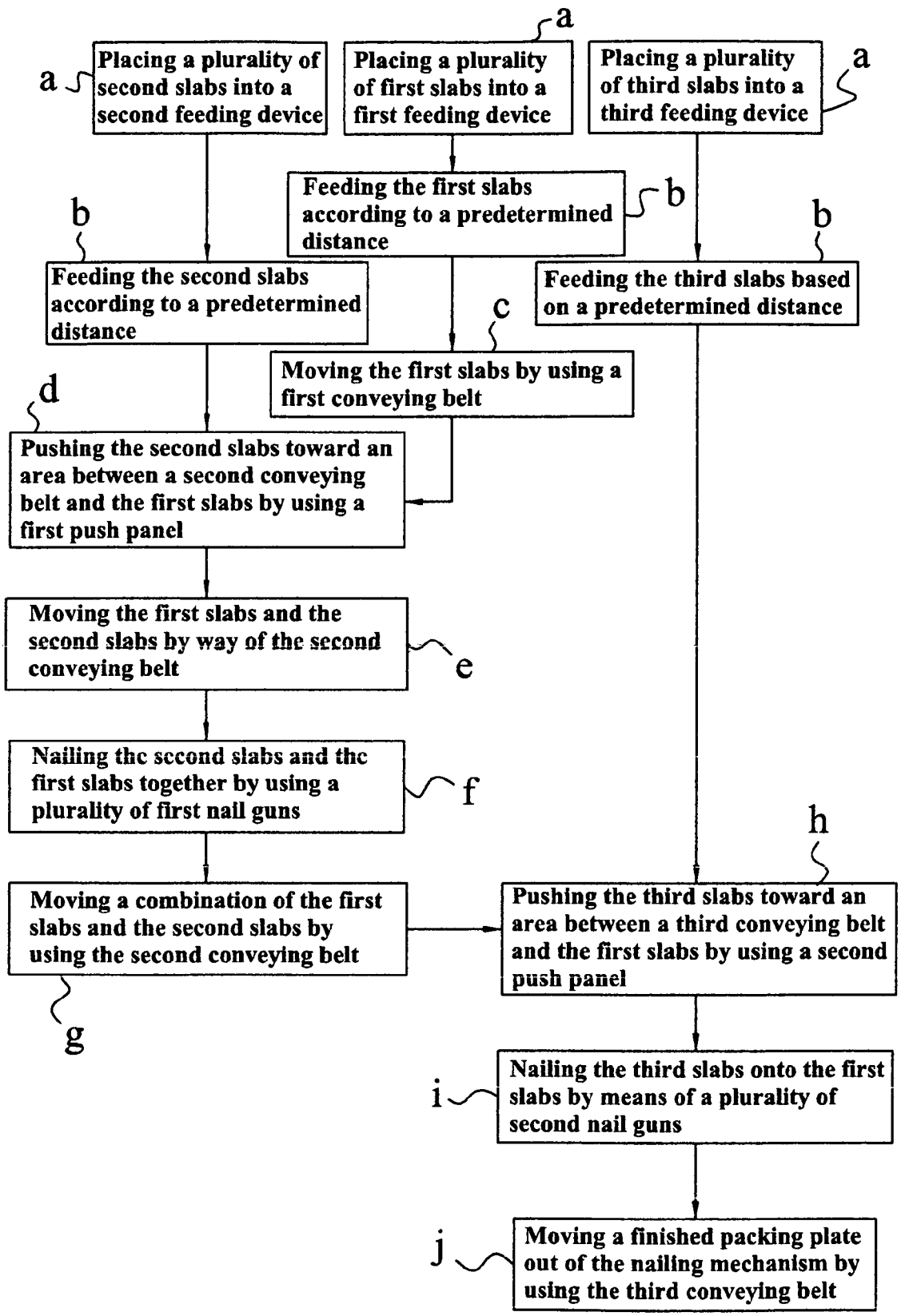
FIG. 1 is a flow chart showing the manufacturing processes of a packing plate according to the present invention.
Figure 2:
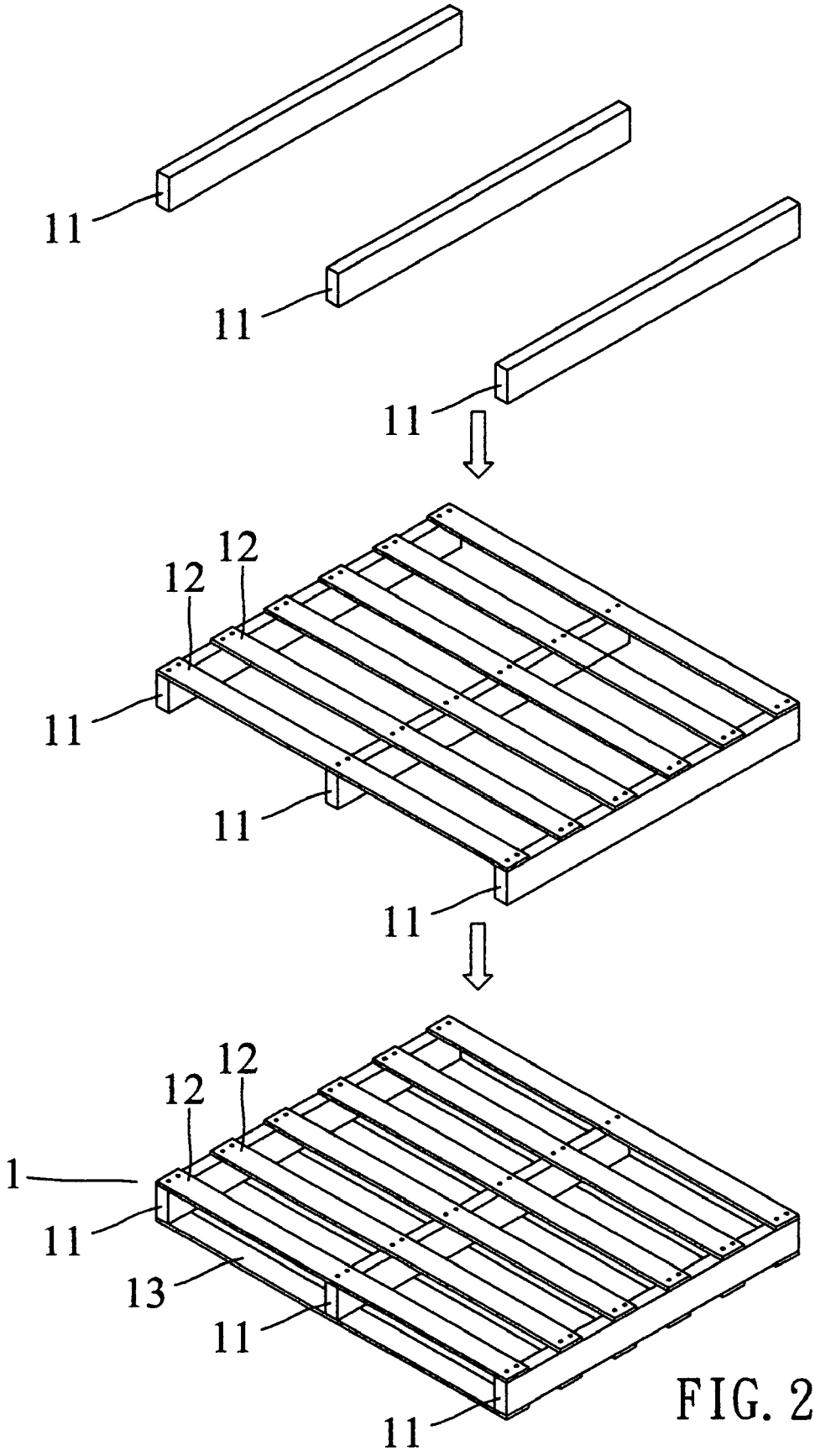
FIG. 2 is a perspective view showing a part of the manufacturing processes of the packing plate according to the present invention.

The present invention will be clearer from the following description when viewed together with the accompanying drawings, which show, for purpose of illustrations only, the preferred embodiment in accordance with the present invention.

A nailing mechanism for a packing plate in accordance with the present invention comprises a middle feeding device, an upper feeding device, a lower feeding device, a first conveying belt, a second conveying belt, a third conveying belt, a first push panel, a second push panel, a plurality of first nail guns, and a plurality of second nail guns, wherein the nailing mechanism are used to automatically assemble a plurality of first, second, and third slabs together to make a finished packing plate, thus lowering production costs and enhancing manufacturing efficiency.

Referring to FIGS. 1-5, the manufacturing processes of the packing plate of the present invention comprises:

a. placing a plurality of first slabs 11, second slabs 12, and third slabs 13 into a first feeding device 2, a second feeding device 3, and a third feeding device 4 respectively to be fed;

b. feeding the second slabs 12 according to a predetermined distance, and feeding the third slabs 13 based on a predetermined distance;

c. moving the first slabs 11 by using a first conveying belt 5, wherein the first slabs 11 are moved by the first conveying belt 5 in an anticlockwise rotating way;

d. pushing the second slabs 12 toward an area between a second conveying belt 5' and the first slabs 11 by using a first push panel 6, wherein the first push panel 6 is disposed on an outlet of the second feeding device 3, and the moving speed of the push panel 6 is set on the basis of a predetermined distance;

e. moving the first slabs 11 and the second slabs 12 by way of the second conveying belt 5', wherein the second conveying belt 5' rotates in an anticlockwise direction;

f. nailing the second slabs 12 and the first slabs 11 together by using a plurality of first nail guns 7;

g. moving a combination of the first slabs 11 and the second slabs 12 by using the second conveying belt 5';

h. pushing the third slabs 13 toward an area between a third conveying belt 5" and the first slabs 11 by using a second push panel 6', wherein the push panel 6' is mounted on an outlet of the third feeding device 4, the moving speed of the push panel 6' is set according to a predetermined distance, and the third conveying belt 5" rotates in a clockwise direction;

i. nailing the third slabs 13 onto the first slabs 11 by means of a plurality of second nail guns 7';

j. moving a finished packing plate 1 out of the nailing mechanism by using the third conveying belt 5".

Figure 3:
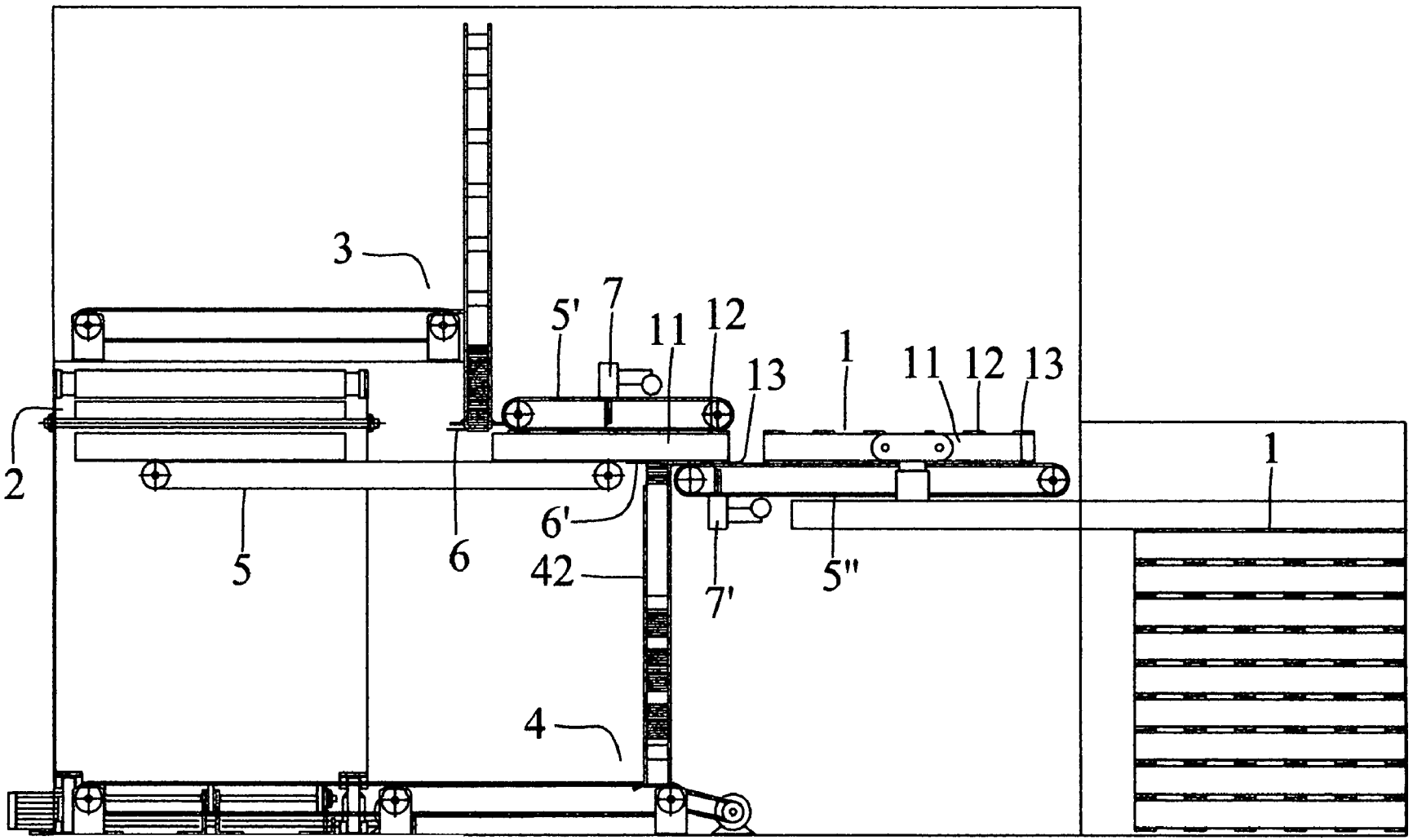
FIG. 3 is a front elevation view showing a nailing mechanism for the packing plate according to the present invention.
Figure 4:
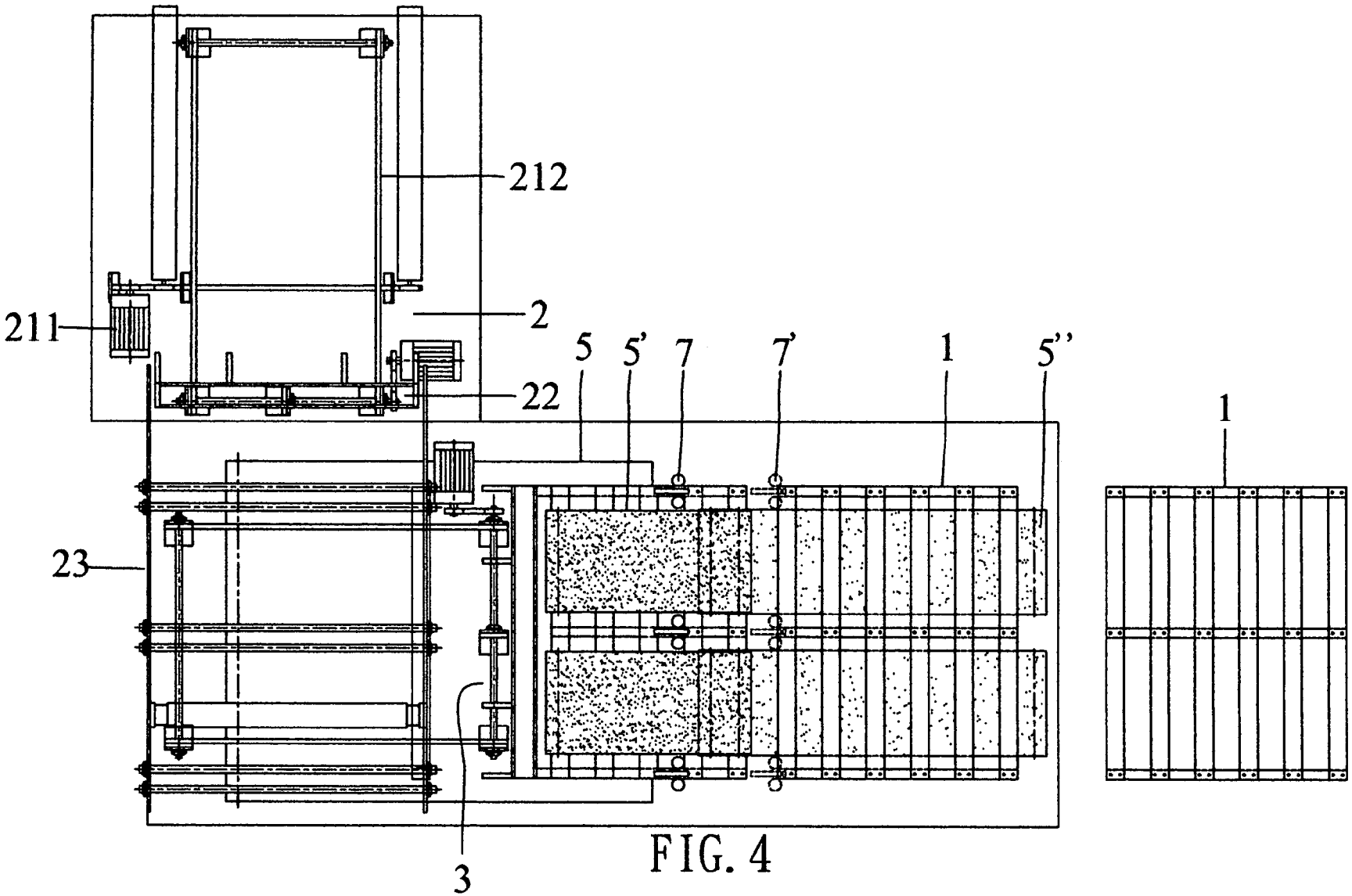
FIG. 4 is a top plan view showing the nailing mechanism for the packing plate according to the present invention.
Figure 5:
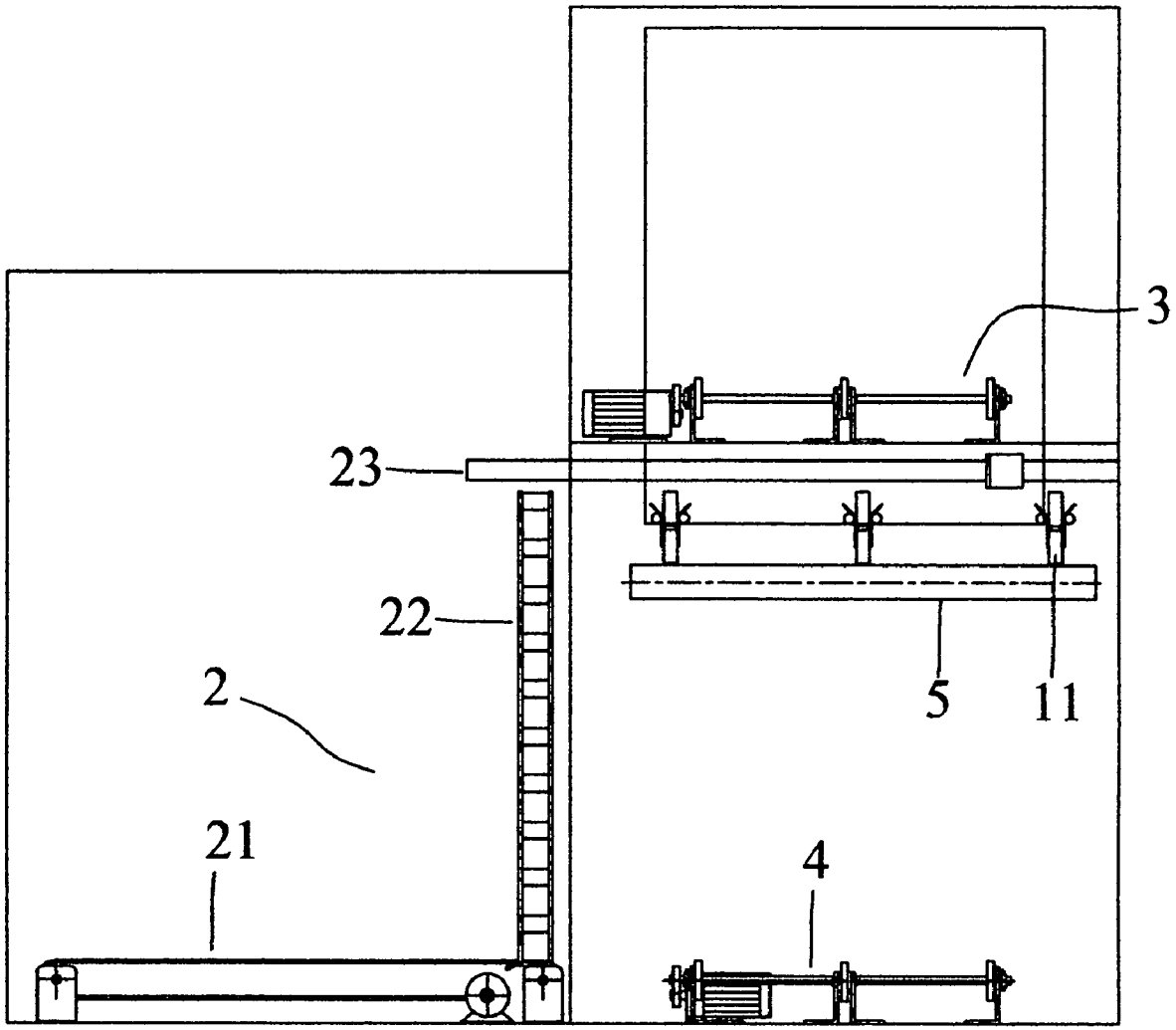
FIG. 5 is a left end elevational view showing the nailing mechanism for the packing plate according to the present invention.

As shown in FIGS. 3-5, the finished packing plate 1 is comprised of the first slabs 11, the second slabs 12, and the third slabs 13, and the related components to manufacture a packing plate by using above-mentioned processes include the first feeding device 2, the second feeding device 3, the third feeding device 4, the first conveying belt 5, the second conveying belt 5', the third conveying belt 5", the first push panel 6, the second push panel 6', the first nail guns 7, and the second nail guns 7'.

Figure 6:
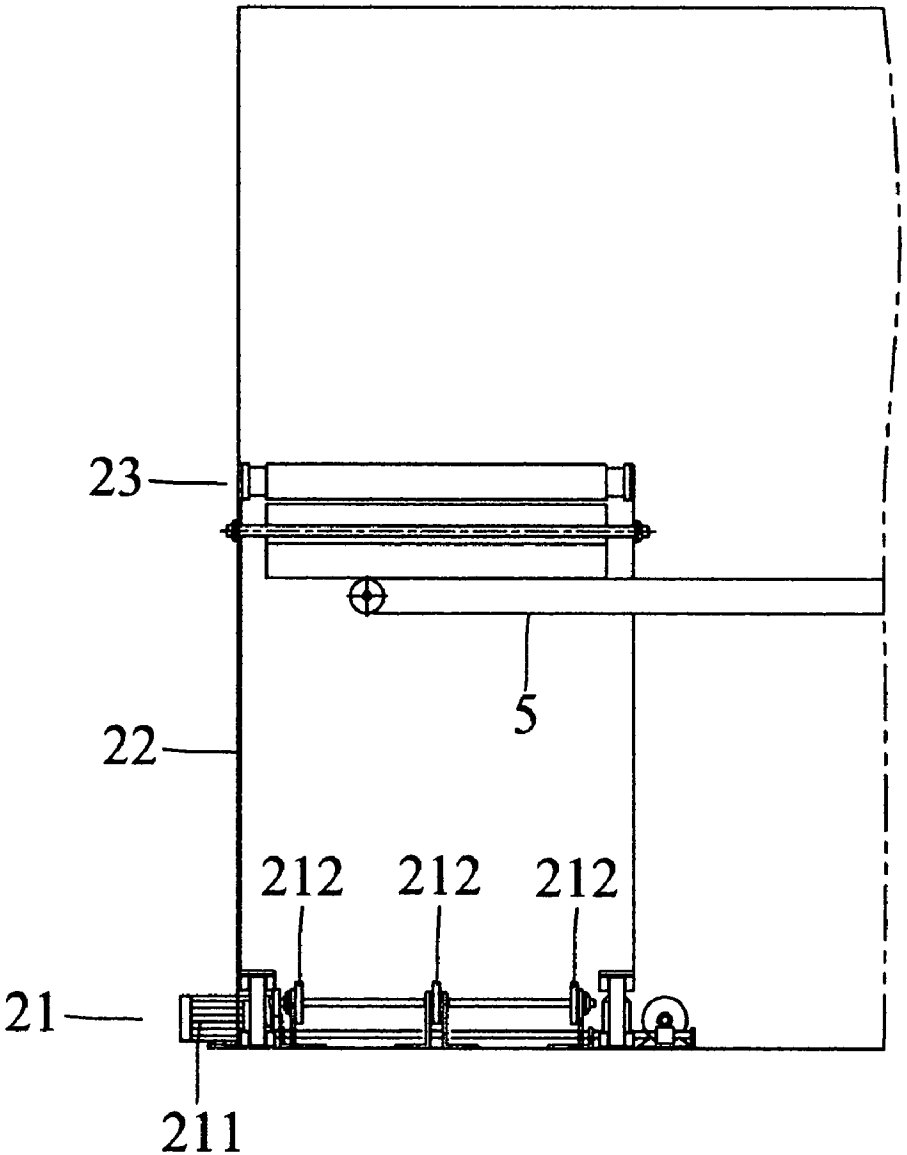
FIG. 6 is a front elevation view showing a first feeding device of the nailing mechanism for the packing plate according to the present invention.
Figure 7:
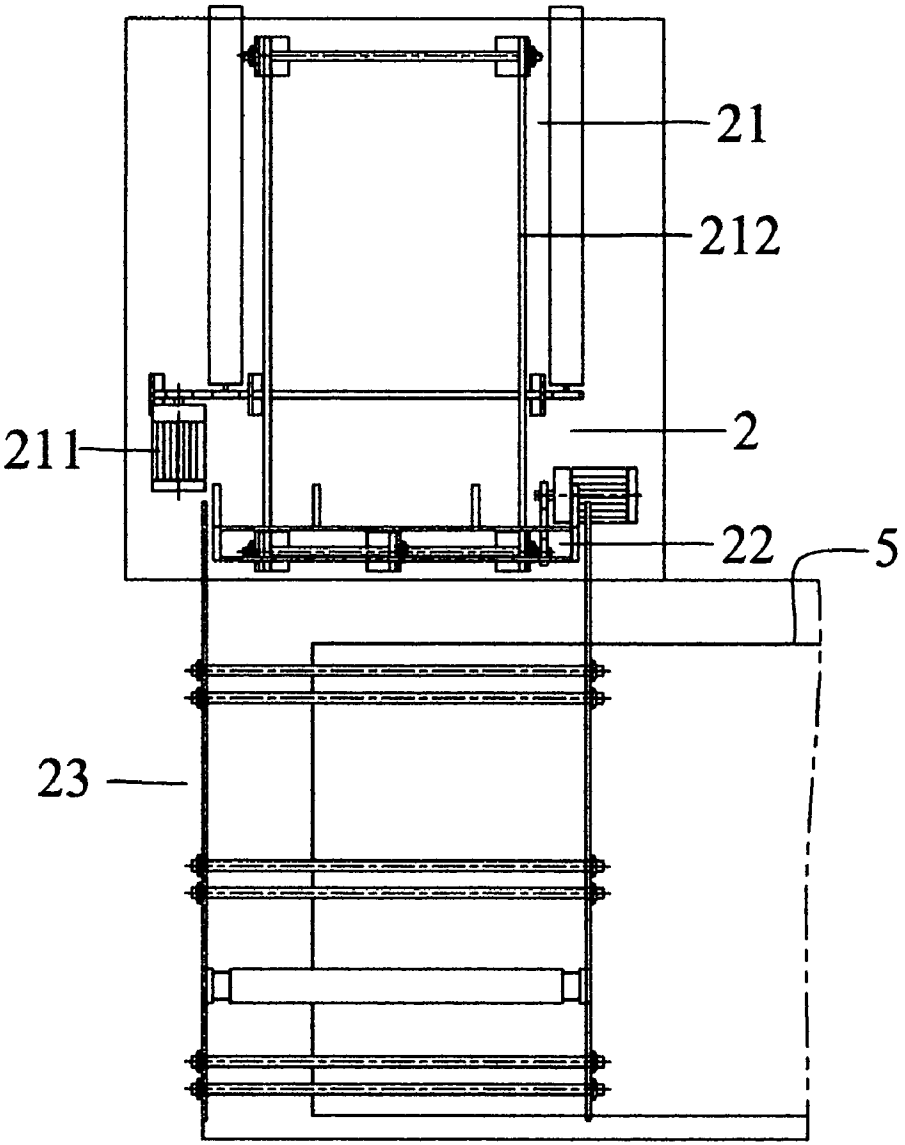
FIG. 7 is a top plan view showing the first feeding device of the nailing mechanism for the packing plate according to the present invention.
Figure 8:
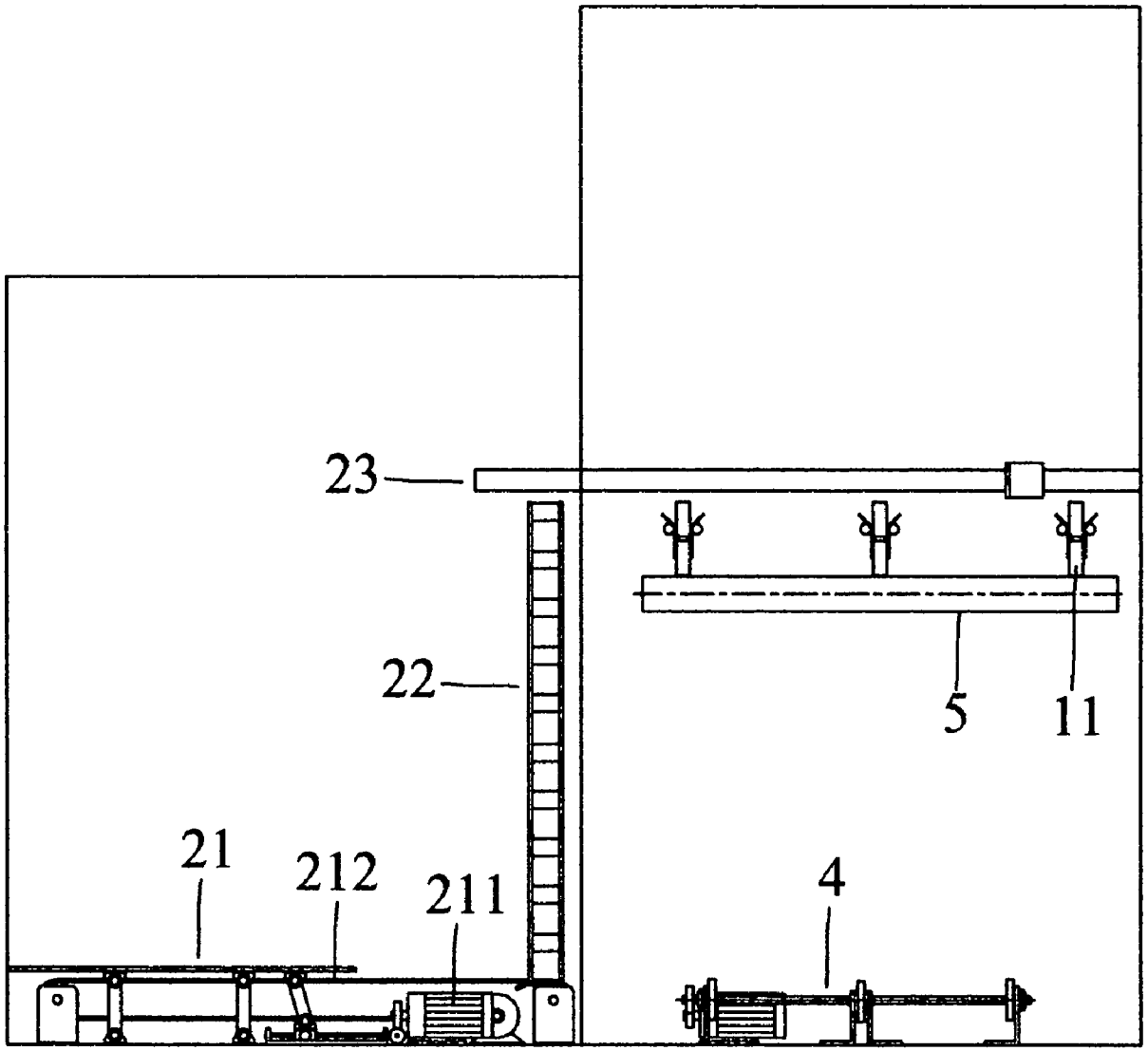
FIG. 8 is a left end elevational view showing the first feeding device of the nailing mechanism for the packing plate according to the present invention.

With reference to FIGS. 6-8, the first feeding device 2 is comprised of a first power transmission portion 21, a first ascending transmission portion 22, and a lateral transmission portion 23. The power transmission portion 21 includes a first motor 211 and a plurality of first chains 212 to rotate clockwise, the first ascending transmission portion 22 is used to move the first slabs 11 upward to a predetermined horizontal moving position to be further moved horizontally. The lateral transmission portion 23 is provided to horizontally move the first slabs 11 above the first conveying belt 5, and the first slabs 11 are fed on the basis of a predetermined distance.

Figure 9:
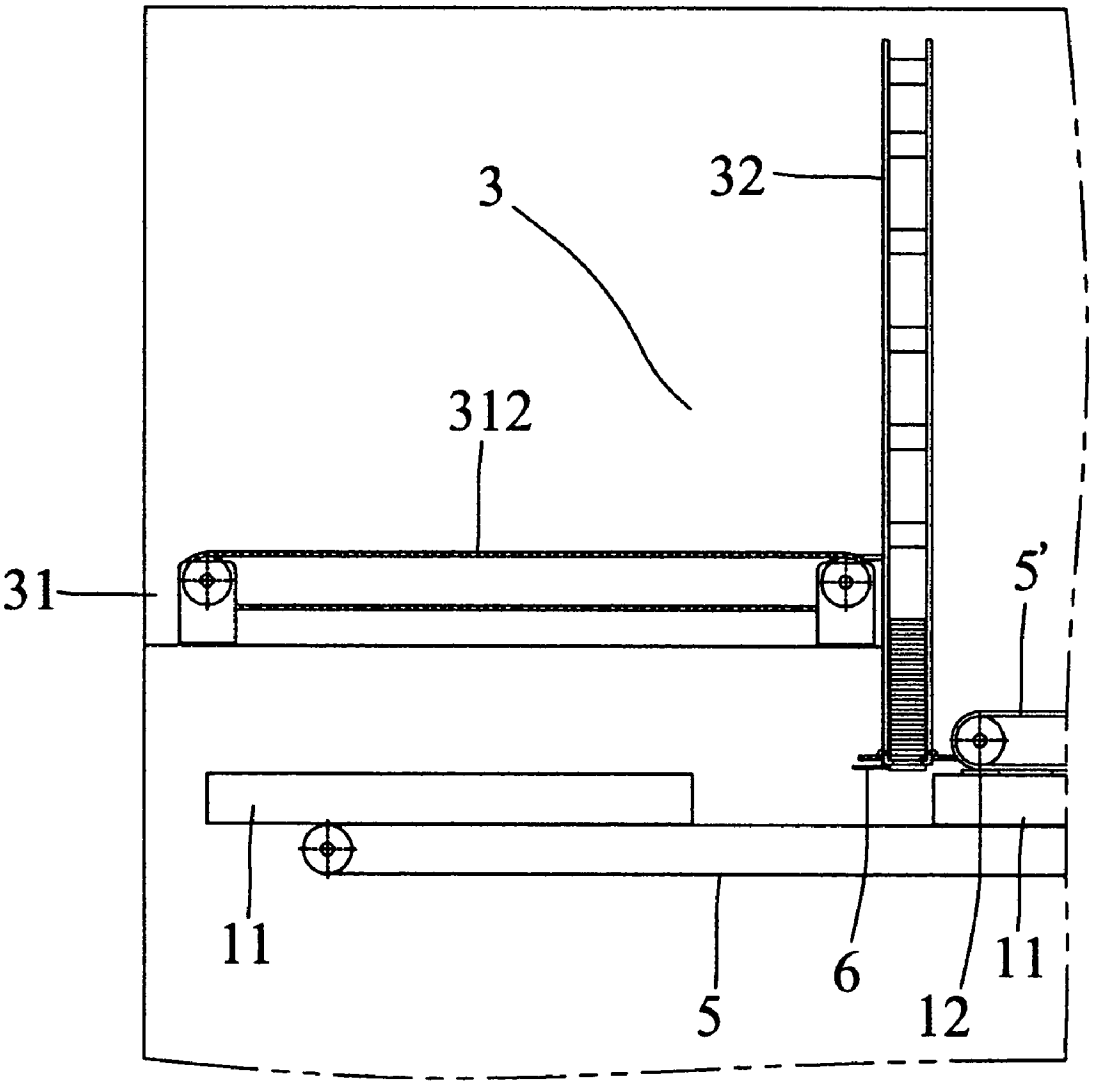
FIG. 9 is a front elevation view showing a second feeding device of the nailing mechanism for the packing plate according to the present invention.
Figure 10:
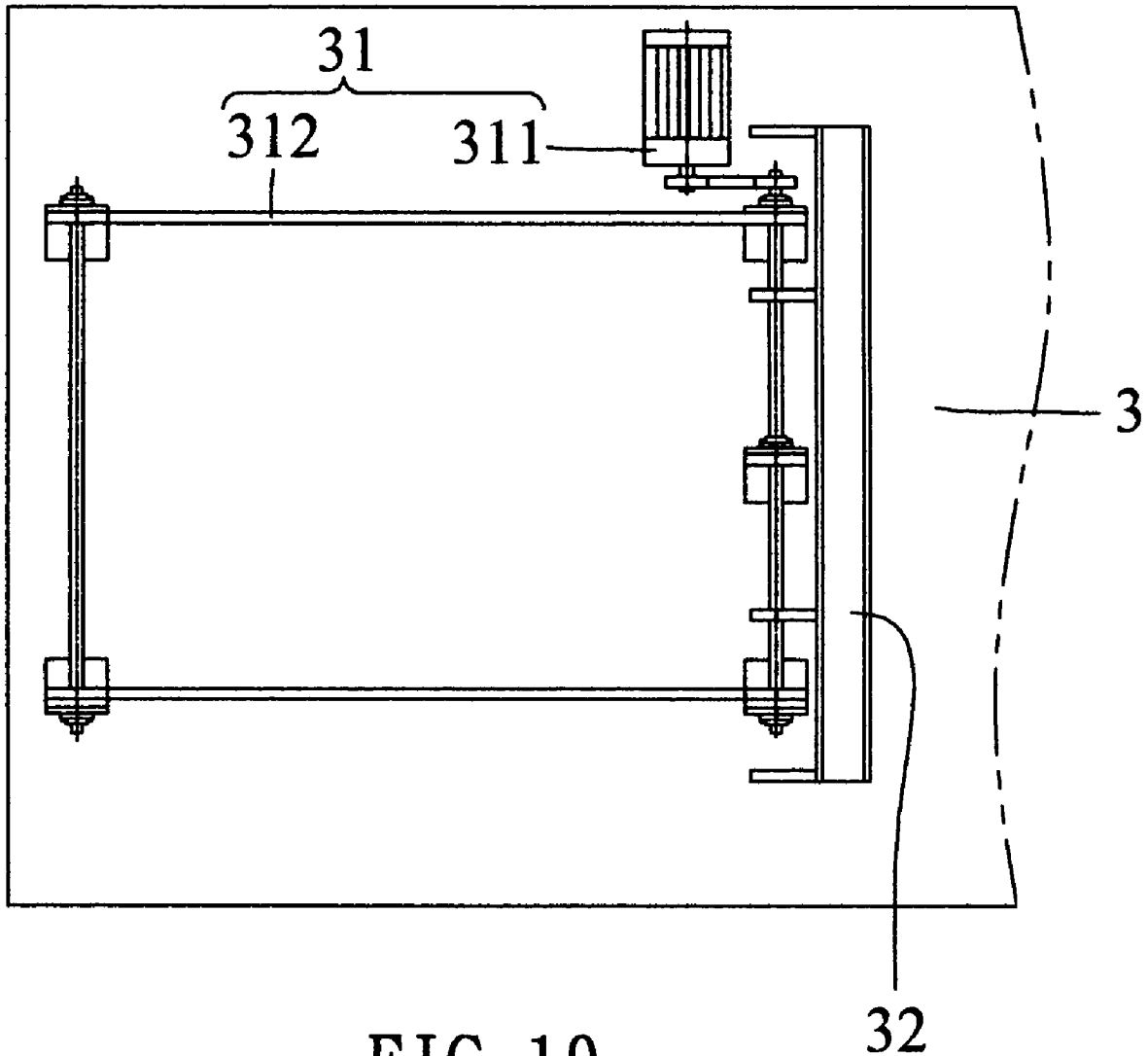
FIG. 10 is a top plan view showing the second feeding device of the nailing mechanism for the packing plate according to the present invention.
Figure 11:
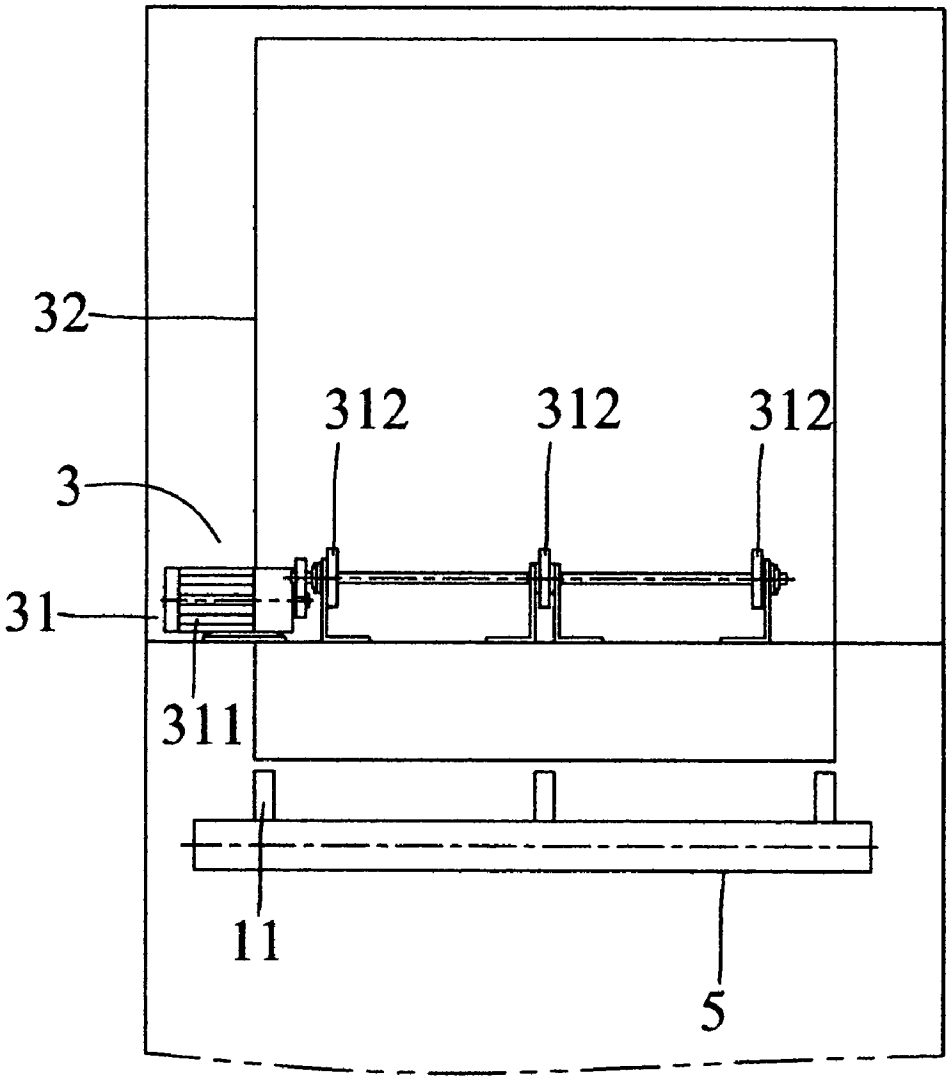
FIG. 11 is a left end elevational view showing the second feeding device of the nailing mechanism for the packing plate according to the present invention.

Referring to FIGS. 9-11, the second feeding device 3 includes a second power transmission portion 31 and a first descending transmission portion 32. The second power transmission portion 31 includes a second motor 311 and a plurality of second chains 312 to rotate clockwise, and on an outlet of the second slabs 12 of the first descending transmission portion 32 is fixed the first push panel 6.

Figure 12:
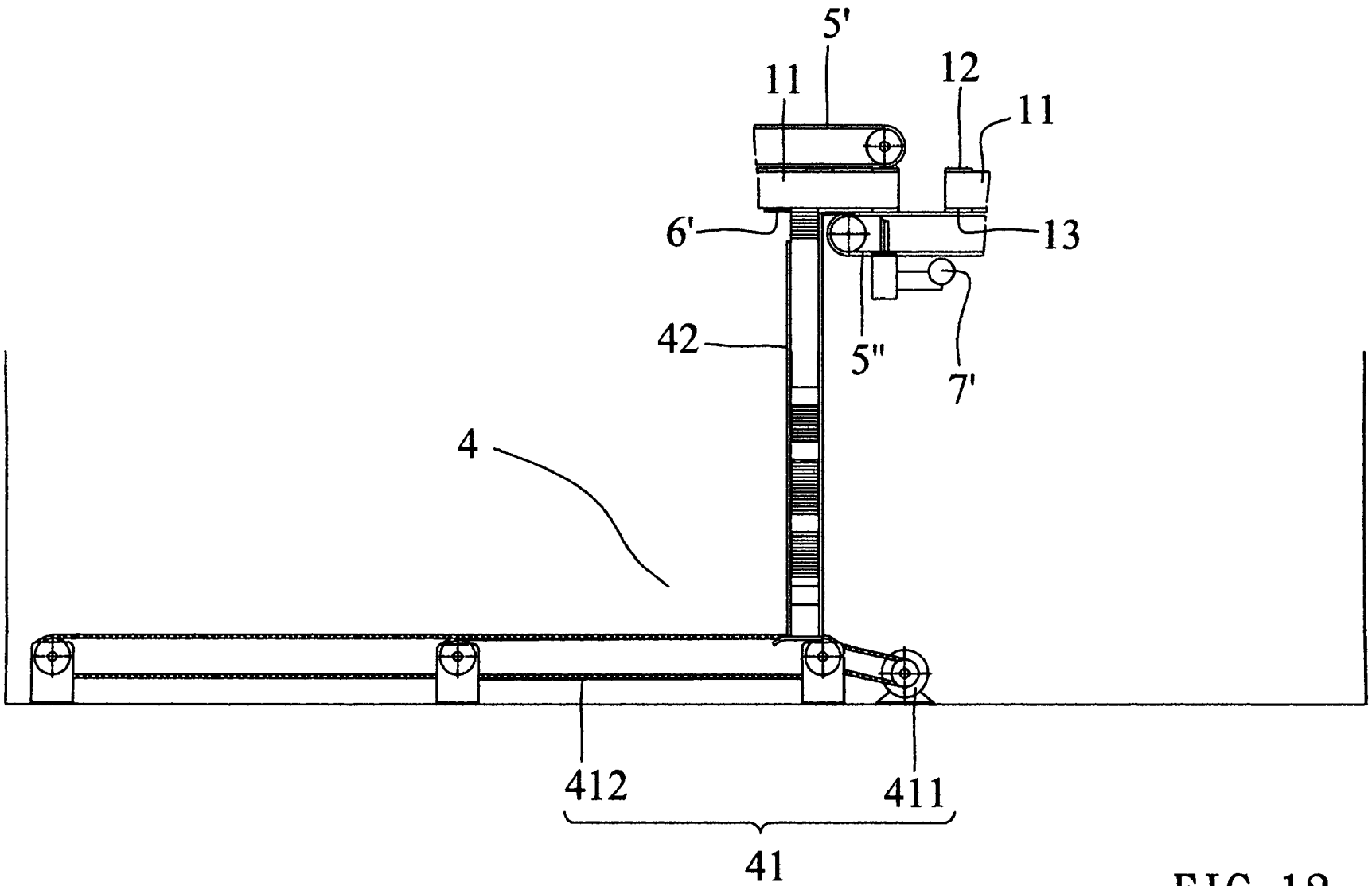
FIG. 12 is a front elevation view showing a third feeding device of the nailing mechanism for the packing plate according to the present invention.
Figure 13:
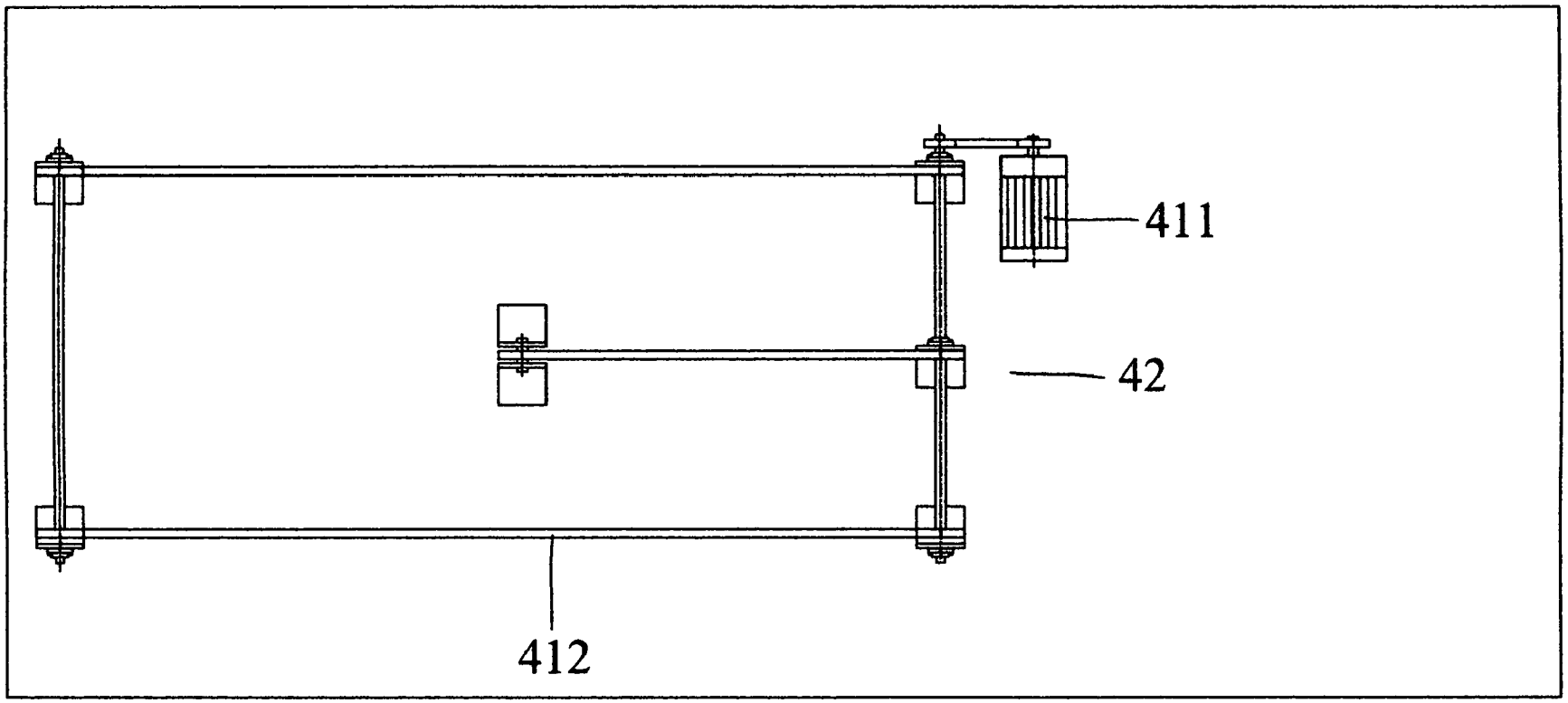
FIG. 13 is a top plan view showing the third feeding device of the nailing mechanism for the packing plate according to the present invention.
Figure 14:
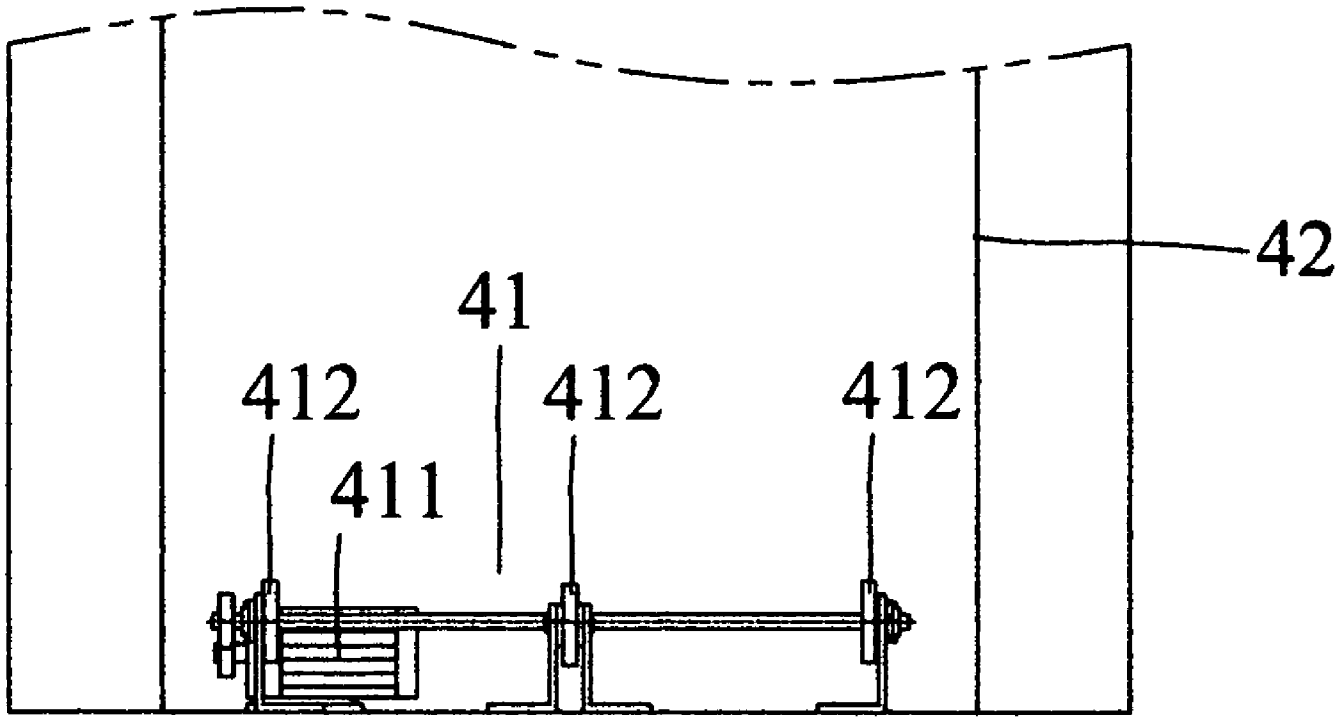
FIG. 14 is a left end elevational view showing the third feeding device of the nailing mechanism for the packing plate according to the present invention.

As shown in FIGS. 12-14, the third feeding device 4 includes a third power transmission portion 41 and a second ascending transmission portion 42. The third power transmission portion 41 includes a third motor 411 and a plurality of third chains 412 to rotate clockwise, and on an outlet of the third slabs 13 of the second ascending transmission portion 42 is secured the second push panel 6'.

The first conveying belt 5 is disposed below the lateral transmission portion 23 of the first feeding device 2 and the first descending transmission portion 32 of the second feeding device 3, and the first conveying belt 5 rotates in an anticlockwise direction.

The second conveying belt 5' is mounted above a rear section of the first conveying belt 5 and rotates in an anticlockwise direction, on a middle section of the second conveying belt 5' are arranged the first nail guns 7 in response to the number and the arrangement of the first slabs 11.

The third conveying belt 5" is fixed below a rear section of the second conveying belt 5' and rotates in a clockwise direction, on a front section of the third conveying belt 5" are arranged the second nail guns 7' in response to the number and the arrangement of the first slabs 11.

As using the nailing mechanism of the present invention, the first slabs 11, the second slabs 12, and the third slabs 13 are placed in the first feeding device 2, the second feeding device 3, and the third feeding device 4 individually to be fed. When the first feeding device 2 drives the second feeding device 3 and the third feeding device 4 to move, the first slabs 11 are fed based on a predetermined distance, and after arranging the first slabs 11 above the first conveying belt 5, the first slabs 11 are laterally moved rearward by the first conveying belt 5. After the end portions of the first slabs 11 pass through the first descending transmission portion 32 of the second feeding device 3, the first push panel 6 located at the outlet of the second slabs 12 of the first descending transmission portion 32 pushes the second slabs 12 into the area between the second conveying belt 5' and the first slabs 11. Thereafter, the first and second slabs 11, 12 are moved by the second conveying belt 5', and the nail guns 7 nail the first and second slabs 11, 12 securely. The combination of the first and second slabs 11, 12 are moved rearward by the second conveying belt 5', and the second push panel 6' fixed on the outlet of the third feeding device 4 pushes the third slabs 13 into the area between the third conveying belt 5" and the first slabs 11 so that the second nail guns 7' can nail the third slabs 13 onto the first slabs 11 securely, thus finishing the packing plate 1 and then moving the finished packing plate 1 out of the nailing mechanism by using the third conveying belt 5".

While we have shown and described various embodiments in accordance with the present invention, it is clear to those skilled in the art that further embodiments may be made without departing from the scope of the present invention.

What is claimed is:

1. A nailing mechanism for a packing plate comprising:

a first feeding device to receive and move a plurality of first slabs of the packing plate;

a second feeding device disposed above the first feeding device to receive and move a plurality of second slabs of the packing plate;

a third feeding device mounted below the first feeding device to receive and move a plurality of third slabs of the packing plate;

a first conveying belt fixed below the first feeding device to carry the fed first slabs of the packing plate;

a second conveying belt mounted above a rear section of the first conveying belt and on an outlet of the second feeding device to hold and convey a combination of the first and second slabs with the rear section of the first conveying belt;

a third conveying belt fixed below a rear section of the second conveying belt and on an outlet of the third feeding device to hold and convey a combination of the first and third slabs with the rear section of the second conveying belt;

a plurality of first nail guns arranged on a middle section of the second conveying belt in response to the number and the arrangement of the first slabs so as to nail the second slabs onto the first slabs securely;

a plurality of second nail guns arranged on a front section of the third conveying belt in response to the number and the arrangement of the first slabs so as to nail the third slabs onto the first slabs securely.

2. The nailing mechanism for the packing plate as claimed in claim 1, wherein the first feeding device comprises:

a first power transmission portion including a first motor and a plurality of first chains driven by the first motor;

a first ascending transmission portion controlled by the first power transmission portion to move the first slabs upward to a predetermined horizontal moving position to be further moved horizontally;

a lateral transmission portion connected with the horizontal moving position to horizontally move the first slabs above the first conveying belt.

3. The nailing mechanism for the packing plate as claimed in claim 1, wherein the second feeding device comprises:

a second power transmission portion including a second motor and a plurality of second chains driven by the second motor;

a first descending transmission portion controlled by the second power transmission portion to move the second slabs downward to a front side of the second conveying belt;

a first push panel fixed on a bottom portion of the first descending transmission portion to push the second slabs of the packing plate onto the second conveying belt.

4. The nailing mechanism for the packing plate as claimed in claim 1, wherein the third feeding device comprises:

a third power transmission portion including a third motor and a plurality of third chains driven by the third motor;

a second ascending transmission portion controlled by the third power transmission portion to move the third slabs of the packing plate upward to a front side of the third conveying belt;

a second push panel fixed on a top portion of the second descending transmission portion to push the third slabs of the packing plate onto the third conveying belt.

* * * * *